United States Patent [19]

Oberrecht

[11] 4,265,281

[45] May 5, 1981

[54] REMOVABLE RACK FOR A LIQUID DISPENSING NOZZLE

[75] Inventor: David A. Oberrecht, Cincinnati, Ohio

[73] Assignee: Dover Corporation, Del.

[21] Appl. No.: 956,369

[22] Filed: Oct. 31, 1978

[51] Int. Cl.[3] ..... B67D 5/37

[52] U.S. Cl. ..... 141/392; 141/218

[58] Field of Search ..... 141/392, DIG. 2, 206, 141/218, 84, 208

[56] References Cited

U.S. PATENT DOCUMENTS 4,036,259 7/1977 Wilder et al. ..... 141/392

4,095,629 6/1978 Jordan ..... 141/392

*Primary Examiner*—William D. Martin, Jr.

*Attorney, Agent, or Firm*—Kinney & Schenk

[57] ABSTRACT

A rack, which cooperates with a trigger of a manually operated handle of an automatic shut-off nozzle, is removably mounted on the nozzle guard so that the nozzle can be utilized in a mechanical hold open mode or a manually controlled mode when the rack is mounted on the guard and cannot be utilized in the mechanical hold open mode when the rack is removed but only in the manually controlled mode.

15 Claims, 7 Drawing Figures

REMOVABLE RACK FOR A LIQUID DISPENSING NOZZLE

When a gasoline dispensing nozzle is utilized by a customer to supply gasoline to the customer's vehicle tank, laws in various states require the nozzle to be of the automatic shut-off type while preventing the use of a mechanical hold open device on the nozzle. Thus, while an automatic shut-off nozzle is legally required in a self-service operation, it may not be legally permissible to use mechanical hold open means for holding the poppet valve in the nozzle in a selected open position to allow flow therethrough at a specific rate.

At some gasoline service stations, there is an attendant on duty during the day with the attendant dispensing gasoline and performing the other usual duties of a service station attendant. Then, at night, the service station has only self-service in which the customer must fill the tank through either a coin controlled operation or by paying an attendant after completion of dispensing the gasoline into the vehicle tank.

With this dual utilization of a gasoline dispensing nozzle, it is desired for the attendant to be able to use a mechanical hold open arrangement since this permits the attendant to perform other full service functions such as washing the windshield, checking the oil level, and checking the coolant level in the radiator, for example. However, with presently available hold open devices on gasoline dispensing nozzles in which a trigger on the valve activating handle cooperates with a rack on the guard, the rack is permanently fixed to the guard by rivets, for example. As a result, any self-service customer, when the station is operated in this dual mode, could utilize the mechanical hold open device on the nozzle. Therefore, the gasoline dispensing nozzles with the mechanical hold open means have not previously been capable of being used in a mechanical hold open mode or a manually controlled mode when an attendant is available and only in a manually controlled mode when being employed for self-service.

The present invention overcomes the foregoing problem through providing a removable rack, which is removably connected or fastened to the guard in a relatively short period of time. Thus, the rack can be mounted on the guard at the start of each work day by the attendant and then removed at the end of the work day. With the removable rack of the present invention, the nozzle can be used in the mechanical hold open mode or the manual mode by the attendant during the time that the station is a full service operation and only in the manual mode when the station is a self-service operation.

In removably mounting the rack on the guard, it is necessary that the rack be always disposed on the guard in a position in which the various desired rates of flow will be obtained when the spring biased trigger, which is pivotally mounted on the manually operated handle or lever, engages a specific notch or step in the rack. That is, the notches or steps in the rack must be properly located in a longitudinal direction each time that the rack is mounted on the guard.

The present invention satisfactorily meets this requirement through utilizing means to always dispose the rack at the same position on the guard without any requirement of the attendant other than disposing the rack on the guard. This insures that the same rate of flow is obtained whenever the trigger is disposed in a specific notch or step of the rack.

An object of this invention is to provide a removable rack for a liquid dispensing nozzle.

Another object of this invention is to provide a removable rack for a liquid dispensing nozzle in which the rack is always mounted at the same position on the guard.

Other objects, uses, and advantages of this invention are apparent upon a reading of this description, which proceeds with reference to the drawings forming part thereof and wherein.

Figure 1:
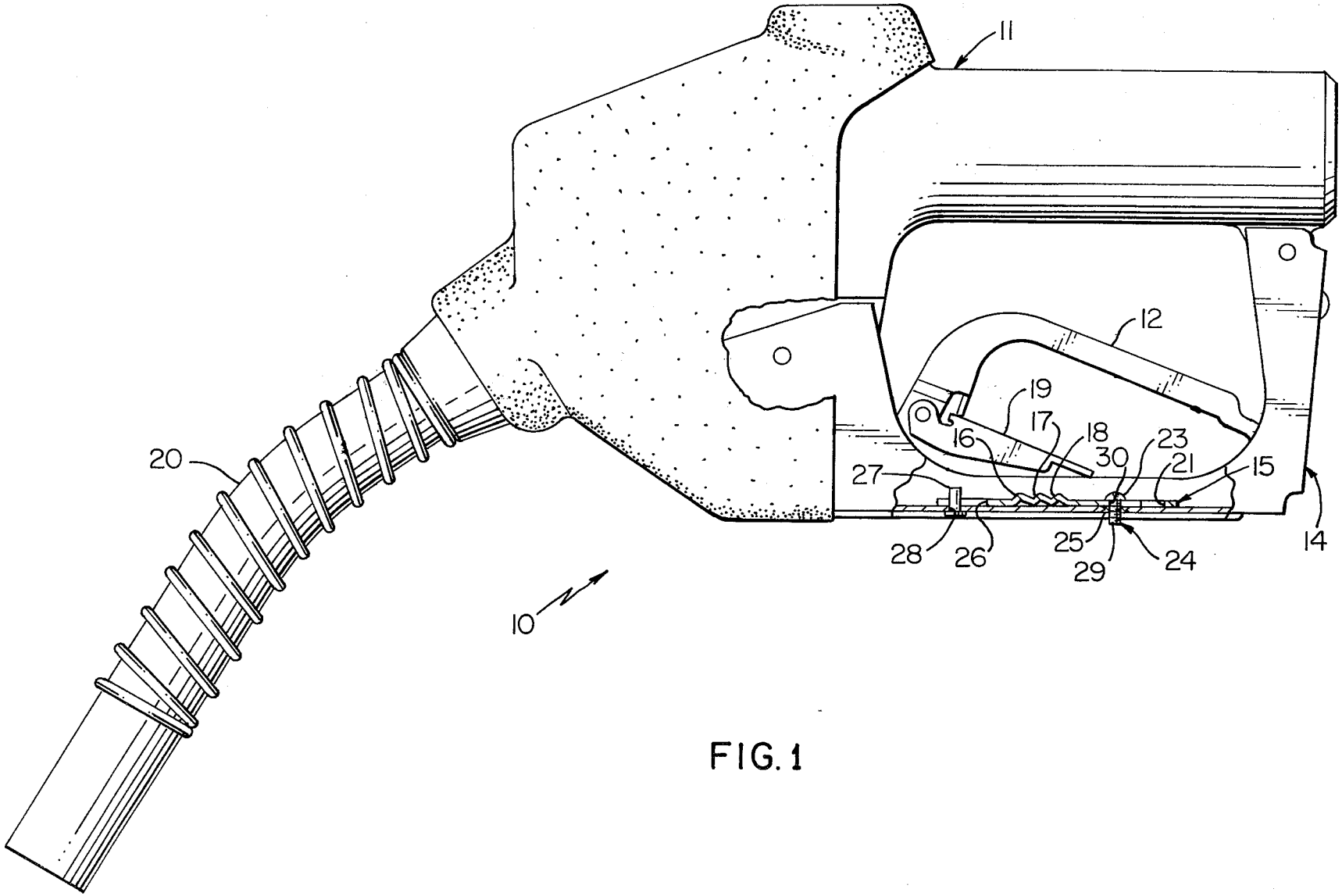
FIG. 1 is a side elevational view, partly in section, of an automatic shut-off nozzle having one form of the removable rack of the present invention mounted thereon.

Referring to the drawings and particularly FIG. 1, there is shown a liquid dispensing nozzle 10 of the automatic shut-off type such as that shown and described in U.S. Pat. No. 3,653,415 to Boudot et al. The nozzle 10 includes a body 11 having liquid flow therethrough controlled by a spring biased poppet valve (not shown), which is moved to its open position by a manually operated handle or lever 12 in the manner more particularly shown and described in the aforesaid Boudot et al patent.

The body 10 includes a guard 14 mounted thereon. The guard 14 has a rack 15 removably mounted thereon. The rack 15 has a plurality of steps or notches 16, 17, and 18 for cooperation with the end of trigger 19, which is pivotally mounted on the handle 12 and biased to the position shown in FIG. 1 by a spring (not shown) in the manner shown and described in the aforesaid Boudot et al patent.

As shown and described in the aforesaid Boudot et al patent, the engagement of the end of the trigger 19 with the step or notch 18 produces the smallest rate of flow of gasoline under automatic shut-off conditions through the nozzle body 11 for dispensing through a spout 20. The engagement of the end of the trigger 19 with the step or notch 16 produces the highest rate of flow of gasoline under automatic shut-off conditions through the nozzle body 11. The engagement of the end of the trigger 19 with the step or notch 17 produces an intermediate rate of flow of gasoline under automatic shut-off conditions through the nozzle body 11.

Figure 2:
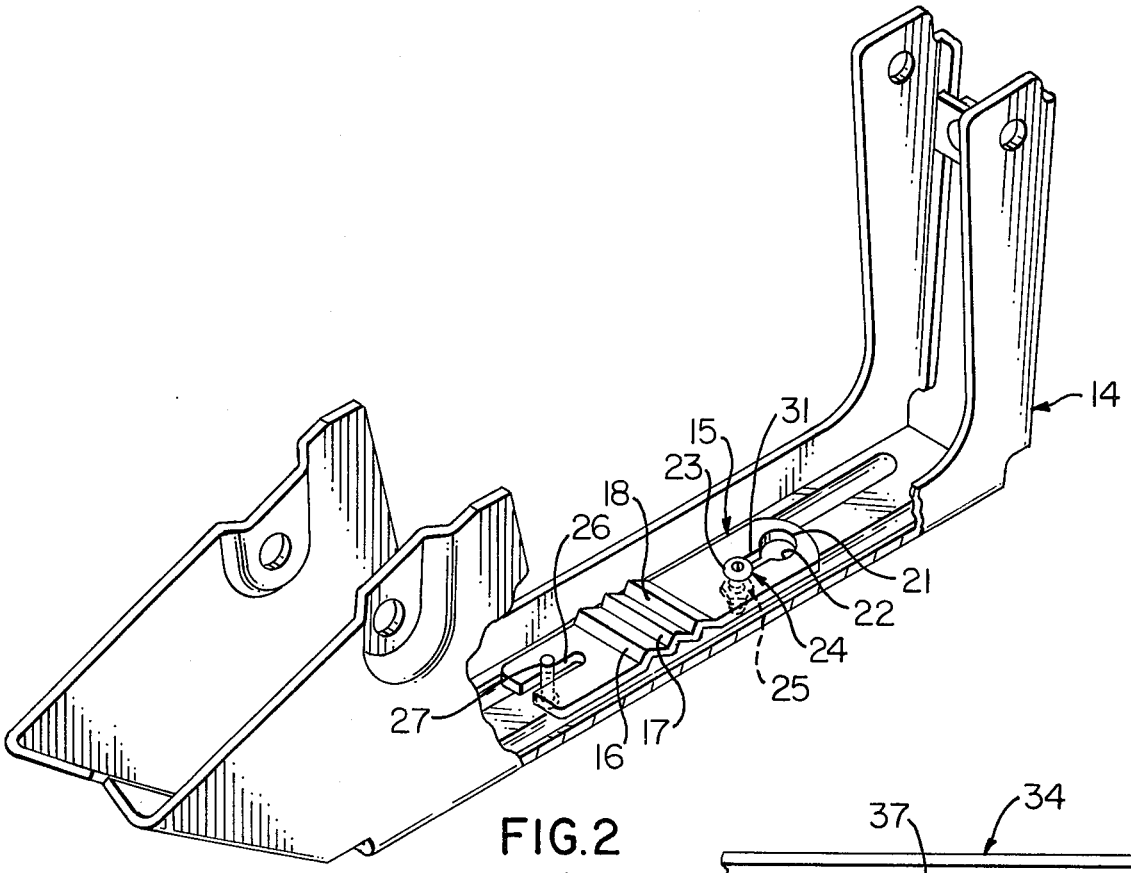
FIG. 2 is a fragmentary perspective view of the rack and a portion of the guard of FIG. 1.

As shown in FIG. 2, the rack 15 has a keyhole slot 21 adjacent one end thereof. The keyhole slot 21 has an enlarged portion 22, which is substantially circular, through which a head 23 of a screw 24 can be received since the head 23 of the screw 24 is smaller than the enlarged portion 22.

The screw 24 is threaded into a threaded insert 25 (see FIG. 1) in the guard 14. One suitable example of the threaded insert 25 is an insert sold as number 55 FLUSH THREADS by Southco, Inc., Lester, PA. One suitable example of the screw 24 is a button head cap screw having a hexagonal slot in the head 23 so that only an Allen wrench can turn the screw 24. This prevents any unauthorized turning of the screw 24 whereby the rack 15 could be removed by an unauthorized person.

The rack 15 has a longitudinal slot 26 in the opposite end of the rack 15 from the end having the keyhole slot 21. A headed spring pin 27, which is press fitted through a hole 28 in the guard 14 from the opposite side of the guard 14 to that on which the rack 15 is mounted, has its stem disposed in the longitudinal slot 26. The longitudinal slot 26 cooperates with the pin 27 to provide the desired longitudinal alignment of the rack 15 on the guard 14.

To removably mount the rack 15 on the guard 14, the enlarged portion 22 (see FIG. 2) of the keyhole slot 21 has the head 23 of the screw 24 passed therethrough with the pin 27 disposed in the longitudinal slot 26. Then, the rack 15 is moved to the right until the screw 24 has its stem 29 engage end 30 (see FIG. 1) of a reduced longitudinal portion 31 (see FIG. 2) of the keyhole slot 21. This engagement of the stem 29 of the screw 24 with the end 30 of the reduced portion 31 of the keyhole slot 21 insures that the rack 15 is disposed at the position at which the desired rate of flow through the body 11 is obtained when the end of the trigger 19 engages one of the steps or notches 16, 17, and 18.

Then, the screw 24 is tightened until the head 23 engages the surface of the rack 15 to lock the rack 15 to the guard 14 in this position. Thus, the rack 15 is prevented against movement and is in the desired location each time through utilizing the cooperation of the screw 24 with the keyhole slot 21.

When it is desired to remove the rack 15, it is only necessary to turn the screw 24 so that the head 23 no longer has a tight fit against the rack 15. Then, the rack 15 is moved to the left until the head 23 of the screw 24 is disposed in the enlarged portion 22 of the keyhole slot 21. This allows the rack 15 to be lifted from the guard 14.

Figure 4:
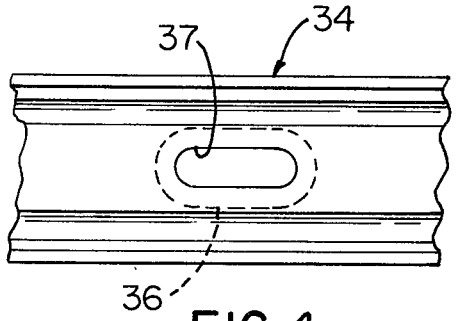
FIG. 4 is a fragmentary top plan view of a portion of the guard of FIG. 3 with the rack removed.
Figure 3:
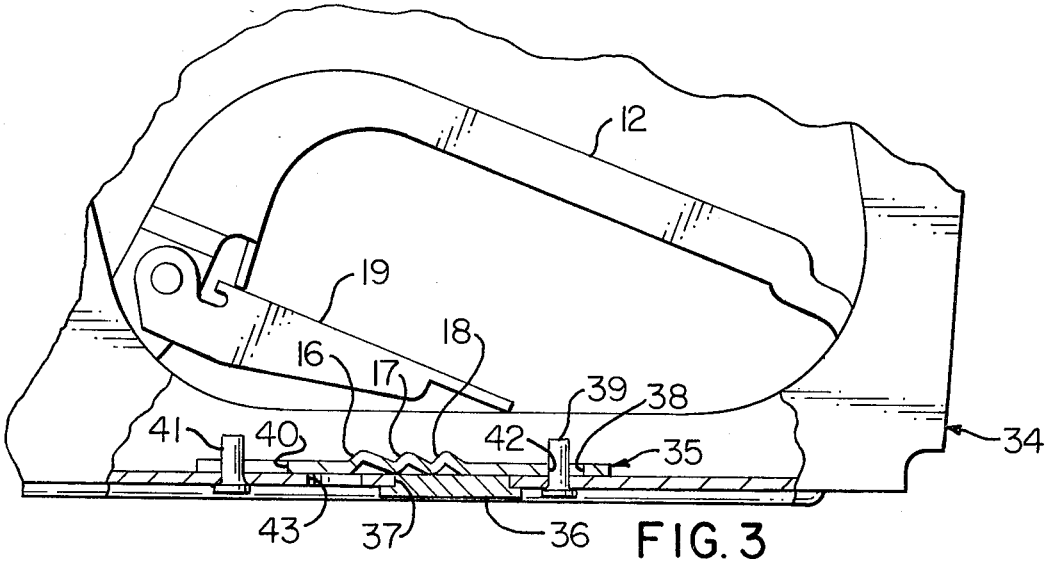
FIG. 3 is a fragmentary elevational view, partly in section, similar to FIG. 1, of the automatic shut-off nozzle of FIG. 1 having another form of the removable rack of the present invention.

Referring to FIGS. 3 and 4, there is shown another form of the invention in which a guard 34 and a rack 35 are utilized in place of the guard 14 and the rack 15 of FIGS. 1 and 2. The rack 35 is formed of a metallic, magnetic material, which is attracted to a magnet 36. The magnet 36 is mounted within a longitudinal slot 37 (see FIG. 4) in the guard 34 by a press fit, for example. Thus, the rack 35 (see FIG. 3) is releasably held on the guard 34 by the magnet 36.

The rack 35 has a first longitudinal slot 38 adjacent one end thereof to receive a pin 39, which is the same as the pin 27. The rack 35 has a second longitudinal slot 40, which is the same as the longitudinal slot 26 in the rack 15, adjacent the other end thereof to receive a pin 41, which is mounted in the guard 34 and is the same as the pin 27. Thus, the longitudinal slot 40 provides the desired alignment of the rack 35.

The pin 39 bears against edge 42 of the slot 38 in the rack 35 to limit movement of the rack 35 to the right. Thus, the pin 39 locates the rack 35 at the desired position on the guard 34 in which the desired rate of flow through the nozzle body 11 is obtained in accordance with which of the steps or notches 16, 17, and 18 that the end of the trigger 19 engages.

To mount the rack 35 on the guard 34, it is only necessary to position the rack 35 so that the pin 41 is disposed within the slot 40 in the rack 35 and the pin 39 is disposed within the slot 38 in the rack 35. Then, the rack 35 is manually pushed to the right until the edge 42 of the slot 38 engages the pin 39 on the guard 34. The force of the trigger 19 on the rack 35 also aids in insuring that the edge 42 of the slot 38 engaes the pin 39.

When it is desired to remove the rack 35 from the guard 34, a screw driver or the like is inserted through an opening 43 in the guard 34 to exert a force on the rack 35 so that the magnet 36 can no longer hold the rack 35 against the guard 34. Thus, easy removal of the rack 35 from the guard 34 is obtained.

Figure 5:
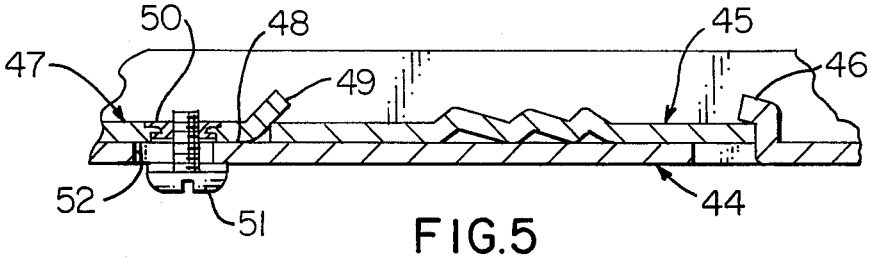
FIG. 5 is a fragmentary sectional view, partly in elevation, of another embodiment of the removable rack and guard of the present invention for use with the nozzle of FIG. 1.
Figure 6:
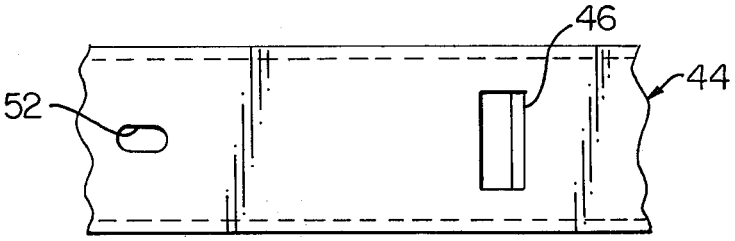
FIG. 6 is a fragmentary top plan view of a portion of the guard of FIG. 5 with the rack removed.

Referring to FIGS. 5 and 6, there is shown a guard 44, which replaces the guard 14 in FIG. 1, and a rack 45, which replaces the rack 15 in FIG. 1. The guard 44 has a bent up tab 46, which preferably extends for the same width as the rack 45.

The guard 44 has a slide 47 slidably mounted on its upper surface 48. The slide 47 has a projecting arm 49 extending from one end thereof. The arm 49 overlies the rack 45 and engages therewith when the rack 45 is removably connected to the guard 44.

The slide 47 has a threaded insert 50 mounted therein to receive a screw 51. The screw 51 extends through a longitudinal slot 52 in the guard 44 to enable movement of the slide 47 along the guard 44.

Accordingly, when the rack 45 is to be disposed on the guard 44, the slide 47 is moved to the left sufficiently to enable the right end of the rack 45 to be disposed against the tab 46 and underneath it as shown in FIG. 5. Then, the slide 47 is moved to the position of FIG. 5 in which the arm 49 overlies the left end of the rack 45 and bears thereagainst. In this position, the screw 51 is tightened by an Allen wrench to lock the slide 47 in the position of FIG. 5 since the head of the screw 51 has a larger diameter than the width of the slot 52. Thus, the rack 45 is positioned at the desired location.

When the rack 45 is to be removed from the guard 44, the screw 51 is released and the slide 47 is moved to the left. Then, the rack 45 can be easily removed from underneath the tab 46.

Figure 7:
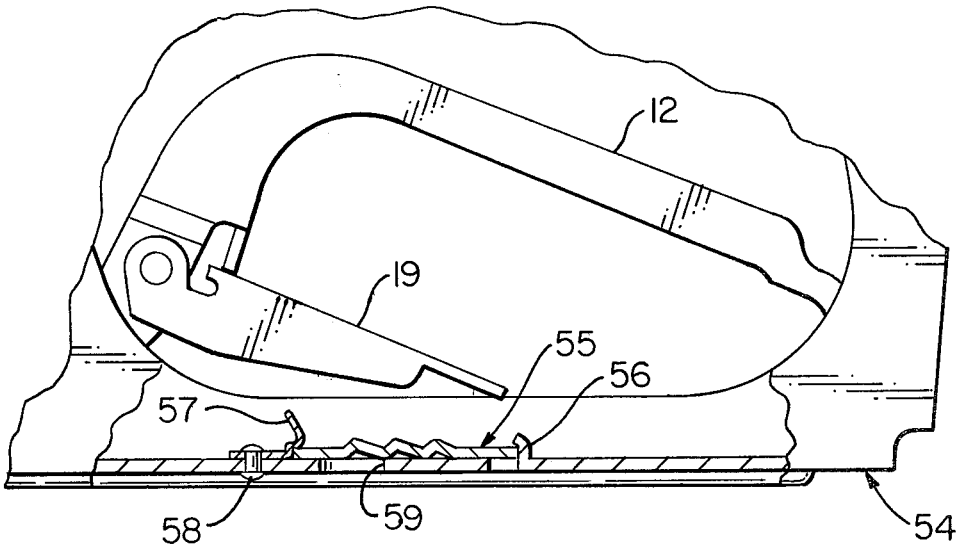
FIG. 7 is a fragmentary elevational view, partly in section, similar to FIG. 1, of the automatic shut-off nozzle of FIG. 1 having a further embodiment of the removable rack of the present invention.

Referring to FIG. 7, there is shown another embodiment of the present invention in which a guard 54 replaces the guard 14 of FIG. 1 and a rack 55 replaces the rack 15 of FIG. 1. The guard 54 has a bent up tab or projection 56, which is preferably the same width as the rack 55, and against which the right end of the rack 55 bears. The tab or projection 56 also overlies the right end of the rack 55.

The guard 54 has a spring clip 57 secured thereto by a rivet 58. The spring clip 57 engages the left end of the rack 55 when the rack 55 is removably connected to the guard 54.

In mounting the rack 55 on the guard 54, the spring clip 57 is pulled to the left so that the rack 55 can be inserted to engage against and beneath the tab 56 on the guard 54. Then, the spring clip 57 is released so that it overlies the left end of the rack 55 and urges the right end of the rack 55 against the tab 56. This removably locks the rack 55 in the desired position on the guard 54.

When it is desired to remove the rack 55 from the guard 54, a screw driver is inserted through a slot 59 in the guard 54 to push against the force of the spring clip 57 through acting on the bottom of the rack 55 so as to move the left end of the rack 55 above the spring clip 57. Then, the rack 55 can easily be removed.

While the embodiment of FIGS. 1 and 2 has shown the rack 15 as having the keyhole slot 21 and the longitudinal slot 26 and the guard 14 having the screw 24 and the pin 27, it should be understood that the screw 24 and the pin 27 could be mounted on the rack 15 with the slots 21 and 26 in the guard 14. Furthermore, if desired, the rack 15 could have one of the slots 21 and 26 while the guard 14 could have the other of the slots 21 and 26 with the screw 24 and the pin 27 being appropriately disposed on the guard 14 and the rack 15.

While the magnet 36 has been shown as being mounted on the guard 34, it should be understood that the magnet 36 could be mounted on the rack 35. It is only necessary that there be magnetic attraction to hold the rack 35 on the guard 34.

An advantage of this invention is that a removable rack is positively located on the guard with which it is used. Another advantage of this invention is that it enables a liquid dispensing nozzle to be used in the mechanical hold open mode by a service station attendant and to function without the mechanical hold open arrangement when no attendant is present.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle including a body, flow control means to control the rate of flow through said body, a guide mounted on said body, a rack removably mounted on said guard, said rack having a plurality of means for selectively holding said flow control means in each of a plurality of predetermined desired positions to control the rate of flow through said body, releasable retaining means for connecting said rack to said guard in a predetermined single position on said guard, longitudinally aligning means on said rack and said guard for cooperation with each other to longitudinally align said rack on said guard when said rack is connected to said guard in the predetermined single position by said releasable retaining means, and cooperating means on said guard and said rack to control the position of said rack on said guard so that said rack is disposed to hold said flow control means at any of the predetermined desired positions when said rack is connected to said guard in the predetermined single position by said releasable retaining means.

2. The nozzle according to claim 1 in which said cooperating means includes a slot in one of said rack and said guard, a member connected to the other of said rack and said guard irrespective of the position of said rack with respect to said guard, and said member being disposed in said slot when said rack is mounted on said guard so as to engage one end of said slot to control the position of said rack on said guard so that said rack is disposed in the predetermined single position on said guard.

3. The nozzle according to claim 2 in which said releasable retaining means includes means on said member to releasably lock said rack to said guard.

4. The nozzle according to claim 3 in which said longitudinally aligning means includes a longitudinal slot in one of said rack and said guard and guide means fixed to the other of said rack and said guard and disposed in said longitudinal slot to longitudinally align said rack on said guard.

5. The nozzle according to claim 2 in which said longitudinally aligning means includes a longitudinal slot in one of said rack and said guard and guide means fixed to the other of said rack and said guard and disposed in said longitudinal slot to longitudinally align said rack on said guard.

6. The nozzle according to claim 1 in which said cooperating means includes a slot in said rack, and a member connected to said guard irrespective of the position of said rack with respect to said guard and disposed in said slot when said rack is mounted on said guard so as to engage one end of said slot to control the position of said rack on said guard so that said rack is disposed in the predetermined single position on said guard.

7. The nozzle according to claim 6 in which said longitudinally aligning means includes a longitudinal slot in said rack and guide means fixed to said guard and disposed in said longitudinal slot to longitudinally align said rack on said guard.

8. The nozzle according to claim 1 in which said cooperating means includes fixed means on said guard engaging one end of said rack to prevent longitudinal movement of said rack in the direction toward said fixed means, said fixed means also longitudinally aligning said rack on said guard to function as said longitudinally aligning means, and said releasable retaining means includes means secured to said guard and overlying the other end of said rack and acting thereagainst to hold said rack against said fixed means on said guard so that said rack is disposed in the predetermined single position on said guard.

9. The nozzle according to claim 8 in which said secured means of said releasable retaining means includes means slidably mounted on said guard and means to releasably retain said slidably mounted means in a position in which the one end of said rack abuts said fixed means on said guard.

10. The nozzle according to claim 1 in which said cooperating means includes fixed means on said guard engaging one end of said rack to prevent movement of said rack in the direction toward said fixed means, said fixed means also longitudinally aligning said rack on said guard to function as said longitudinally aligning means, and said releasable retaining means includes resilient means secured to said guard and overlying the other end of said rack and acting thereagainst to urge said rack against said fixed means on said guard so that said rack is disposed in the predetermined single position on said guard.

11. A liquid dispensing nozzle including a body, flow control means to control the rate of flow through said body, a guard mounted on said body, a rack mounted on said guard, said rack having a plurality of means for selectively holding said flow control means in each of a plurality of predetermined desired positions to control the rate of flow through said body, at least a portion of one of said guard and said rack being formed of metallic material attracted to a magnet, a magnet supported on the other side of said guard and said rack to releasably lock said rack to said guard in a predetermined single position on said guard, longitudinally aligning means on said rack and said guard for cooperating with each other to longitudinally align said rack on said guard when said rack is connected to said guard in the predetermined single position, and cooperating means on said guard and said rack to control the position of said rack on said guard so that said rack is disposed to hold said flow control means at any of the predetermined desired positions when said rack is connected to said guard in the predetermined single position.

12. The nozzle according to claim 11 in which at least a portion of said rack is formed of a metallic material attracted to a magnet and said magnet is supported on said guard to releasably lock said rack to said guard.

13. The nozzle according to claim 12 in which said longitudinally aligning means includes a longitudinal slot in one of said rack and said guard and guide means fixed to the other of said rack and said guard and disposed in said longitudinal slot to longitudinally align said rack on said guard.

14. The nozzle according to claim 11 in which said longitudinally aligning means includes a longitudinal slot in one of said rack and said guard and guide means fixed to the other of said rack and said guard and disposed in said longitudinal slot to longitudinally align said rack on said guard.

15. A liquid dispensing nozzle including a body, flow control means to control the rate of flow through said body, a guard mounted on said body, a rack removably mounted on said guard, said rack having a plurality of means for selectively holding said flow control means in each of a plurality of predetermined desired positions to control the rate of flow through said body, fixed means on said guard engaging one end of said rack to prevent movement of said rack in the direction toward said fixed means to dispose said rack in a predetermined single position on said guard and to longitudinally align said rack, and resilient means secured to said guard and overlying the other end of said rack and acting thereagainst to urge said rack against said fixed means on said guard to control the position of said rack on said guard so that said rack is disposed in the predetermined single position on said guard to hold said flow control means at any of the predetermined desired positions when said rack is connected to said guard.

* * * * *